United States Patent [19]

Lyle

[11] 4,057,222

[45] Nov. 8, 1977

[54] CONCRETE VIBRATOR

[75] Inventor: John S. Lyle, Denver, Colo.

[73] Assignee: Koehring Company, Milwaukee, Wis.

[21] Appl. No.: 658,594

[22] Filed: Feb. 17, 1976

[51] Int. Cl.[2] ..... B01F 1/00; F01C 1/10; F03C 3/00; F04C 1/06

[52] U.S. Cl. ..... 366/123; 259/DIG. 43; 418/171

[58] Field of Search ..... 259/1 R, DIG. 43; 418/171, 166, 181

[56] References Cited

U.S. PATENT DOCUMENTS

| | | | |
|---|---|---|---|
| 2,215,888 | 9/1940 | Swarthout | 259/DIG. 43 X |
| 2,762,339 | 9/1956 | Schroeder | 418/171 |
| 3,240,158 | 3/1966 | Brundage | 418/171 X |
| 3,551,081 | 12/1970 | Brundage | 418/171 |
| 3,695,791 | 10/1972 | Brundage | 418/171 X |

*Primary Examiner*—Harvey C. Hornsby
*Assistant Examiner*—Robert Pous
*Attorney, Agent, or Firm*—Burns, Doane, Swecker & Mathis

[57] ABSTRACT

Immersion vibrator of the type employed for consolidating poured concrete and employing an unbalanced rotor, characterized by a gerotor type motor, operated by hydraulic pressure, for rotating the rotor. It is of particular utility as an accessory to certain paving machines having an engine driven hydraulic circulating pump.

1 Claim, 7 Drawing Figures

CONCRETE VIBRATOR

BACKGROUND OF THE INVENTION

In the consolidation or compacting of poured concrete aggregate, to eliminate voids therein, it is common practice to employ vibration generators which are immersed in the poured aggregate and moved to various positions therein to create local vibrations which cause the aggregate to settle into a voidless mass, essential for maximum strength when the mass sets. Such generators are often formed as elongated prods of relatively small diameter so that they may be immersed between obstructions, such as reinforcing steel, placed in a form prior to pouring the aggregate. Often, the vibration generator is an unbalanced rotor, rotated by a power source, such as an air motor disposed within the prod adjacent one end of the rotor, the air motor being supplied with air under pressure through flexible supply and exhaust hoses connected to one end of the prod. Flexible drive shafts have also been proposed, one end of the flexible shaft being connected to a suitable remote motor. Further, electric motors, contained within the prod, have been proposed.

Of the various motors of small size and relatively high power which may be incorporated in the space available with the prod, piston, vane and spur gear motors all present possibilities but each has its disadvantages. For example, piston motors are usually complicated due to their various movable parts, including valves. Vane motors are usually somewhat more simple but may be subject to considerable wear from foreign matter in the fluid operating medium. Paired conventional meshing gears are simplest of the various motors referred to but the axes of rotation are spaced apart creating a large objectionable enclosing envelope and some sort of transmission mechanism to place the axis of an output drive shaft on the geometric axis of the prod. Theoretically then, a turbine, rotatable about the prod and rotatable weight axis would provide the ideal drive in a minimum space. Turbines, however have poor torque at lower speeds and to obtain a desired output torque it is necessary to rotate the turbine at extremely high speed and reduce it through a speed reducer. It is not uncommon for the speed reducer to be many times larger than the turbine. A turbine, of course, is not a positive displacement motor (or engine) like the others referred to and derives its torque through fluid velocity, either through the principle of impulse or reaction (or a combination thereof).

Where the eccentric weight speed is of the order of 10,000–12,000 RPM this presents problems for driving same directly by an electric motor. While electric motors operating at such speeds on conventional 60 cycle AC are well known, they are of the "universal" type which require commutators and brushes which adds to the complexity of construction and which also require periodic maintenance.

Certain engine driven paving machines are also well known which drive their various instrumentalities mechanically or by a high pressure hydraulic circulating pump. They are, however, devoid of an electrical or air source of energy for operating a vibrator. Also, if the vibrator were driven by a flexible shaft, as is well known, this would require a cumbersome engine power take-off and speed change transmission to operate the vibrator at optimum speed. It becomes apparent, accordingly, and particularly for use with a paving machine of the type referred to, that improvements in a vibrator drive means would be advantageous to meet the various criteria involved in an optimum manner of simplification.

SUMMARY OF THE INVENTION

The present invention is characterized by the general combination of a concrete vibrating prod, an unbalanced mass, such as a rotor therein, the rotor being driven by a motor other than the various types just referred to. The motor is analogous to the spur gear motor referred to but an externally toothed member is disposed within an internally toothed member, commonly known as a "Gerotor" motor. The internal member is normally provided with one less tooth than the surrounding member and the teeth are so shaped to obviate tooth interference but to provide a tooth seal therebetween at all points of tooth contact. The axes of rotation of the two members are thus spaced only slightly as compared to a spur gear motor wherein they are spaced the sum of their pitch radii. Inlet and outlet arcuate ports are provided (without movable valves) so that hydraulic pressure acts on about 180° of the tooth peripheries of the members. It is thus a positive displacement motor but no appreciable expansion takes place since the motive fluid is a liquid. A typical Gerotor motor is shown in U.S. Pat. No. 3,490,383.

In accordance with the foregoing, the principal object of the invention is to provide a combination of a cylindrical concrete vibrating prod including an unbalanced rotary mass driven by a hydraulic motor contained in the prod, the motor being of a size and type which may be contained within the tubular prod casing or envelope.

Another object is to utilize a Gerotor type hydraulic motor having meshing toothed members which rotate about slightly spaced axes to thereby permit the motor to be contained within a minimum space and within the envelope. This permits maximizing the weight of the unbalanced mass relative to the total weight of the prod and results in a lightweight prod requiring low power input. For a given input of power, the prod will then provide greater amplitude and frequency vibrations making it more efficient in consolidating wet concrete.

Another object is to provide a Gerotor type motor devoid of movable valves other than the inherent valving of its meshing teeth.

Another object is to provide a Gerotor type motor which may rotate the unbalanced mass at an optimum high speed.

Another object is to provide a prod for use with a conventional paving machine which includes an engine and a hydraulic pump driven thereby for use wherein an electrical or air source of energy is unavailable and a mechanical source is impractical.

A further object is to provide a prod for manual manipulation in structure forms or the like which may be driven by a recirculating hydraulic pump driven by a suitable motor or engine.

Still further objects, advantages and salient features will become more apparent from the detailed description to follow, the appended claims, and the accompanying drawings to now be briefly described.

DESCRIPTION OF THE PREFERRED EMBODIMENT

Figure 1:
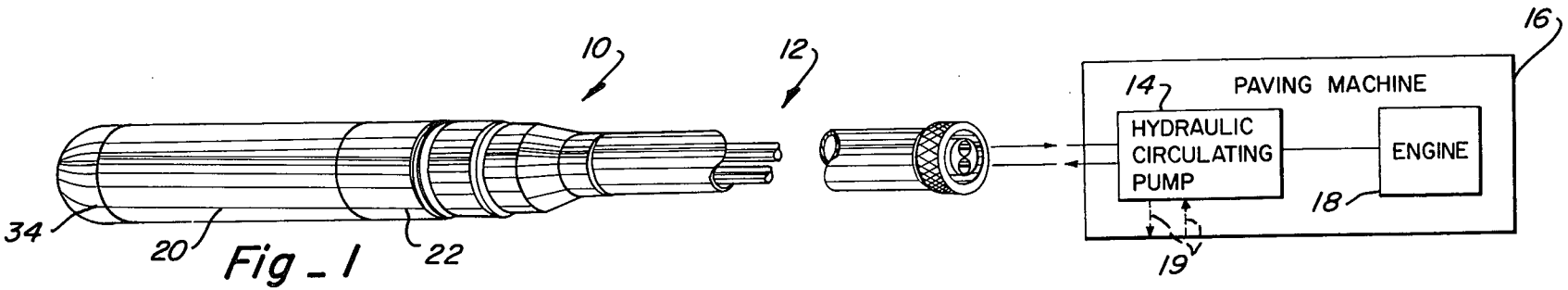
FIG. 1 depicts the subject of the invention for use with a conventional paving machine, the latter being illustrated diagrammatically.

Referring now to the drawings, and first to FIG. 1, the subject of the invention comprises an elongated prod 10 containing a hydraulic motor and eccentric weight driven thereby, to subsequently be described in detail, connected by a dual flexible conduit 12 to a suitable source of high pressure liquid, such as oil, which as illustrated, is a recirculating pump 14 carried by a convention paving machine 16 and driven by an engine 18. As will be understood, the engine may supply power for the operation of various instrumentalities of the paving machine including those driven by the pump, as indicated by dotted lines 19 connected thereto. A plurality of such prods may be affixed to the machine, across its width, to consolidate poured concrete as the machine continuously advances along its path. When employed with concrete poured in fixed structure forms, the prod may be manually moved to various loci therein, such as between reinforcing steel.

Figure 2:
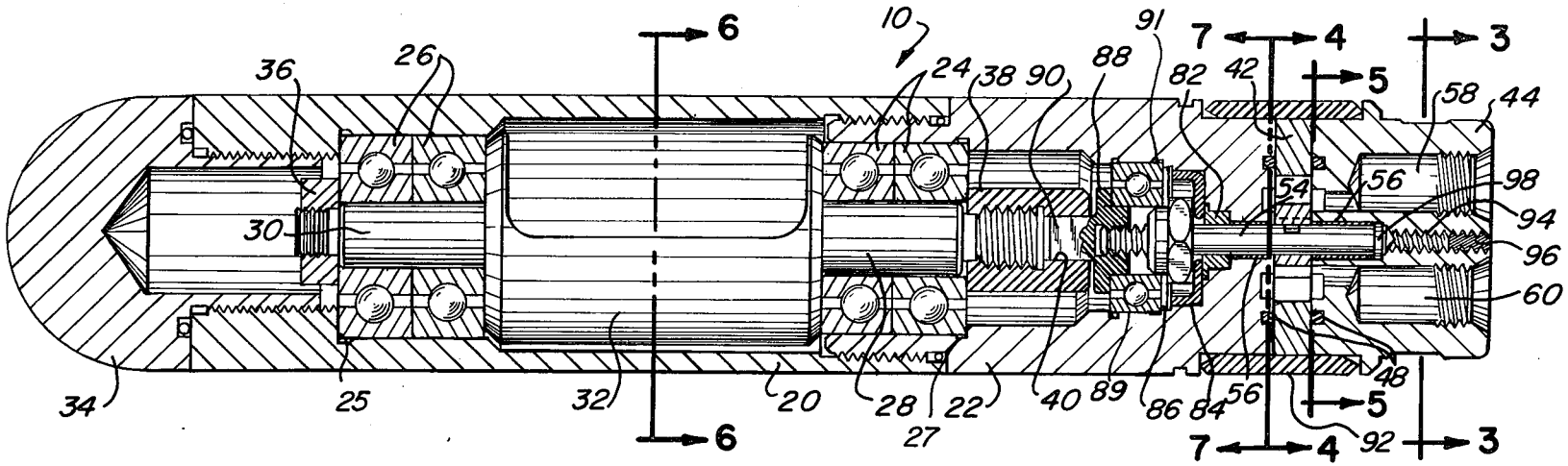
FIG. 2 is an enlarged central longitudinal section of the prod illustrated at the left side of FIG. 1 and approximately to full scale.
Figure 3:
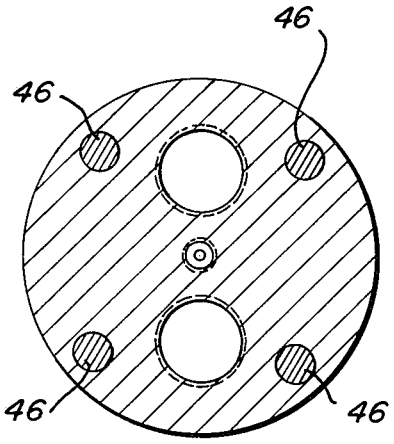
FIG. 3 is a section taken on line 3—3 of FIG. 2.

Referring to FIG. 2, prod 10 comprises a pair of tubular sections 20,22 threadedly connected together which carry ball bearings 24,26 which support pintles 28,30 forming a part of a rotor 32, which as shown, is cut away to form an eccentric or unbalanced mass which rotates about the pintle axes. The first bearing 24 abuts against a rearwardly facing shoulder 25 in the first tubular section 20, and the second bearing 26 abuts against a forwardly facing shoulder 27 in the second tubular section 22. A suitable cap 34 threadedly engages member 20 to prevent entry of foreign matter into the rotor casing. As will be apparent, when rotor 32 is rotated, the prod moves in a circular orbit, principally in a plane perpendicular to the rotor axis, producing a gyrating vibration which will be imparted to the fluid-like concrete after it has been poured along the pavement strip or into a form. A nut 36 threadedly engages pintle 30 and a like nut 38 threadedly engages pintle 28 to maintain the rotor in a fixed axial position within tubular section 22, nut 38 being provided with a diametrical cross slot 40, forming a positive female dog clutch for driving same.

Figure 4:
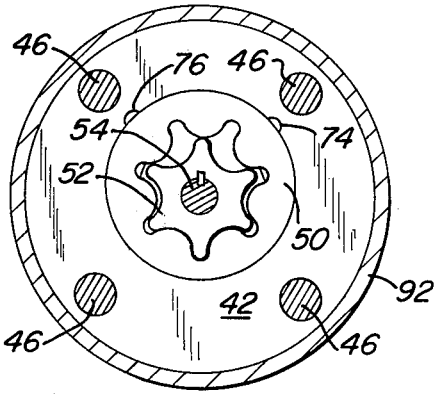
FIG. 4 is a section taken on line 4—4 of FIG. 2 and rotated 90°.
Figure 6:
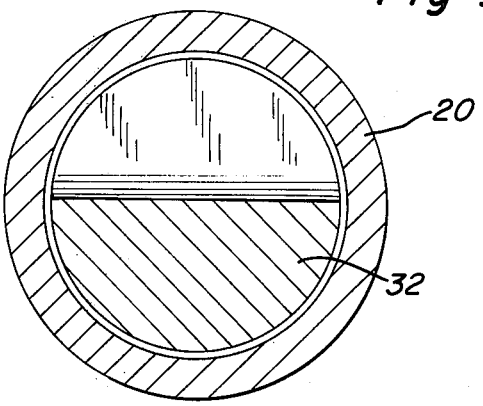
FIG. 6 is a section taken on line 6—6 of FIG. 2.
Figure 7:
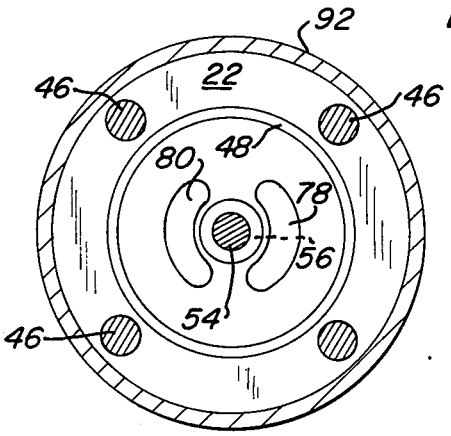
FIG. 7 is a section taken on line 7—7 of FIG. 2 and rotated 90°.
Figure 5:
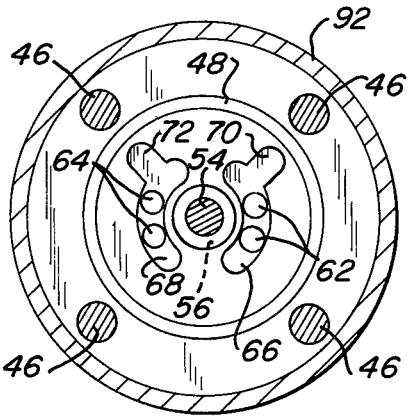
FIG. 5 is a section taken on line 5—5 of FIG. 2 and rotated 90°.

The hydraulic motor for rotating the eccentric weight 32 comprises a stationary ring 42 secured to one end of member 22 by a closure 44 and cap screws 46 extending therethrough, threadedly engaging member 22, and sealed at opposite faces by sealing means such as O rings 48. An internally toothed ring 50 is journaled for rotation in the bore of the stationary ring, the teeth of which mesh with the external teeth of a rotor or pinion 52, secured to a shaft 54, journaled for rotation by needle bearings 56,56. Diametrically disposed internally threaded conduits 58,60 extend into closure 44 which communicate with pairs of apertures 62,64 which communicate with arcuate inlet and outlet slots 66,68 in the left face of closure 44. Also, as best shown in FIG. 5, slots 66,68 communicate, respectively, with slots 70,72 which communicate with slots or cut-outs 74,76, best shown in FIG. 4, which extend across the width of stationary ring 42 to provide lubrication to the periphery of internally toothed rotatable ring 50. Arcuate ports 78,80 axially aligned with ports 66,68, best shown in FIG. 7, are also provided in the end face of member 22 to thereby equally pressurize opposite end faces of ring 50 and rotor 52 to obviate end thrust pressure of these members.

Again referring to FIG. 1, a suitable seal 82, retained in position by a cup 84 and snap ring 86, surrounds shaft 54 to prevent oil leakage into the interior of the eccentric weight housing. The left end of shaft 54 is threadedly secured to a nut 88 which is provided with diametrically disposed flats 90, forming a male dog clutch which engages the slots in the female dog clutch, previously described. The nut 88 is rotatably mounted in a ball bearing 89 which abuts against a forwardly facing shoulder 91 in the second tubular section 22. A surrounding and clamping means, such as band 92, surrounds the prod, and particularly ring 42, end cap 44 and the right end of the prod. Suitable structure (not shown) is affixed to band 92 for securing the prod to a paving machine, or a handle, in the event the prod is manually manipulated in the poured concrete.

As will be apparent from the construction illustrated, the threaded connections between the prod housing permit ready disassembly thereof for access to the unbalanced rotor for servicing or replacement of the bearings which support same. Also, by removing the four cap screws at the right end of the prod, all of the rotor parts become accessible for like purposes. To aid in the removal of the right needle bearing, a threaded hole 94, closed by a plug 96, may be provided through which a rod may be inserted to engage a disk 98 disposed adjacent the right end of the right needle bearing.

The motor illustrated, which is approximately full size, rotates the eccentric weight at about 10,000 RPM and develops about 1.5 HP at about 800 PSI supply pressure.

The invention has been described in detail with particular reference to a preferred embodiment thereof, but it will be understood that variations and modifications can be effected within the spirit and scope of the invention.

What is claimed is:

1. Apparatus for vibrating a flowable medium, such as poured concrete aggregate, comprising:

an end cap;

a first tubular section having a front-end threadedly connected to a rear end of said end cap;

said first tubular section having a rearwardly facing shoulder;

a first bearing assembly mounted within said first tubular section adjacent a front end thereof in abutting relationship with said rearwardly facing shoulder;

a second tubular section having a front end threadedly connected to a rear end of said first tubular section;

said second tubular section having a first forwardly facing shoulder and a second forwardly facing shoulder spaced rearwardly therefrom;

a second bearing assembly mounted in said second tubular section in abutting relationship with said first forwardly facing shoulder;

an unbalanced mass disposed in said first tubular section, said mass having axially opposed front and rear pintles rotatably mounted in said first and second bearing assemblies, respectively;

a first nut threadedly connected to said front pintle forwardly of said first bearing assembly to retain said first bearing assembly;

a second nut threadedly connected to a rear end of said rear pintle to retain said second bearing assembly;

a third bearing assembly disposed in said second tubular section in abutting relationship with said second forwardly facing shoulder;

a third nut rotatably mounted in said third bearing assembly and including a forward projection removably received in a rearwardly open slot of said second nut to form a rotary drive connection therebetween;

a stationary ring disposed at a rear end of said second tubular section;

a closure connected to said second tubular section by removable fasteners extending through said stationary ring, to secure said stationary ring between said second tubular section and said closure;

a shaft having a front end rotatably mounted in a needle bearing in said second tubular section and a rear end rotatably mounted in a needle bearing in said closure, said shaft extending through a bore of said stationary ring;

the front end of said shaft being threadedly connected to said third nut to form a rotary drive connection therebetween;

an internally toothed ring journalled for rotation in said bore of said stationary ring;

an externally toothed rotor keyed on said shaft for rotation within said internally toothed ring;

said internally toothed ring having one tooth less than said rotor;

a first sealing ring held between a front end of said stationary ring and a rear end of said second tubular section to form a fluid seal therebetween;

a second sealing ring held between a rear end of said stationary ring and a front end of said closure to form a fluid seal therebetween;

a fluid inlet conduit and a fluid outlet conduit extending through said closure in directions parallel to one another and parallel to the axis of said shaft;

said inlet conduit being connectible to a source of pressurized hydraulic fluid;

a first pair of arcuate slots located in a forward face of said closure in fluid communication with said inlet and outlet conduits, respectively;

said first pair of slots facing rearward faces of said internally toothed ring and said rotor and communicating with spaces between such ring and rotor, to conduct hydraulic fluid thereto and therefrom for rotatably driving said shaft and said unbalanced mass;

said first pair of slots extending beyond an outer periphery of said internally toothed ring and communicating with cut-outs formed in the bore wall of said stationary ring to conduct hydraulic fluid across the outer periphery of said internally toothed ring to lubricate the latter;

a second pair of slots located in a rear face of said second tubular section and facing front faces of said internally toothed ring and said rotor in axial alignment with respective ones of said first pair of slots, to equalize pressures at the front and rear faces of said internally toothed ring and said rotor;

a fluid seal disposed around said shaft in said second tubular section axially between said third bearing assembly and said rotor to prevent the passage of hydraulic fluid to said unbalanced mass;

retaining means disposed forwardly of said fluid seal and rearwardly opposite said third bearing; and said closure having a hole aligned with said shaft, to facilitate removal of said needle bearing from said closure.

* * * * *